United States Patent [19]

Shely et al.

[11] Patent Number: 4,897,899

[45] **Date of Patent: * Feb. 6, 1990**

[54] CABLE TIE

[75] Inventors: William W. Shely, St. Charles; Peter M. Wells, Elgin, both of Ill.

[73] Assignee: All States Inc., Chicago, Ill.

[ * ] Notice: The portion of the term of this patent subsequent to Dec. 6, 2005 has been disclaimed.

[21] Appl. No.: 224,584

[22] Filed: Jul. 26, 1988

Related U.S. Application Data

[63] Continuation-in-part of Ser. No. 107,295, Oct. 9, 1987, Pat. No. 4,788,751.

[51] Int. Cl.[4] ..... B65D 63/00

[52] U.S. Cl. ..... 24/16 PB; 24/17 AP

[58] Field of Search ..... 24/16 PB, 17 AP, 17 A, 24/305 P, 20 TT; 248/74, 3; 292/318, 320, 322

[56] References Cited

U.S. PATENT DOCUMENTS

| | | | |
|---|---|---|---|
| 3,102,311 | 9/1963 | Martin et al. | 24/16 PB |
| 3,155,987 | 11/1964 | McGill | 2/322 |
| 3,494,002 | 2/1970 | Kabel | 24/16 PB |
| 3,605,199 | 9/1971 | Eberhardt | 24/16 PB |
| 3,967,345 | 7/1976 | Sumimoto | 24/16 PB |
| 3,973,292 | 8/1976 | Bonnet | 24/16 PB |
| 3,991,444 | 11/1976 | Bailey | 24/16 PB |
| 4,128,919 | 12/1978 | Bulanda et al. | 24/20 TT |
| 4,263,697 | 4/1981 | Speedie | 24/30.5 P |
| 4,413,380 | 11/1983 | Suzuki | 24/17 AP |
| 4,573,242 | 3/1986 | Lankton | 24/16 PB |

FOREIGN PATENT DOCUMENTS

| | | | |
|---|---|---|---|
| 2139091 | 3/1972 | Fed. Rep. of Germany | 24/16 PB |

*Primary Examiner*—Victor N. Sakran

*Attorney, Agent, or Firm*—Laff, Whitesel, Conte & Saret

[57] ABSTRACT

A cable tie comprises a strap having a plurality of spaced parallel racks of teeth extending along the length thereof and a head for receiving the strap. A reinforcing median strip extends along the length of the strap between the racks of teeth to add material thickness, and mechanical strength to the strap. A bifurcated pawl is included in the head so that a separate pawl engages each rack of teeth. The teeth in each rack are in substantial, contiguous alignment. The teeth in the pawls are also in substantial, contiguous alignment for engaging the teeth of the strap. The median strip guides and directs the pawls as they ratchet over and come to rest in a locked position against said rocks of teeth.

8 Claims, 2 Drawing Sheets

CABLE TIE

This application is a continuation-in-part of co-pending, commonly assigned patent application 07/107,295, filed Oct. 9, 1987 now U.S. Pat. No. 4,788,751.

This invention relates to cable ties and more particularly to cable ties with a more reliable holding characteristic and a reduced insertion force.

Cable ties are molded plastic devices which have a strap and a head. The strap has a rack of transverse teeth extending along the length thereof. The head includes an opening containing a pawl which mates with and ratchets over the rack of teeth on the strap. The end of the strap is inserted through the opening and then pulled tight. As the strap tightens, the pawl locks into the teeth to prevent the strap from loosening. An example of such a cable tie is found in U.S. Pat. No. 3,605,199.

Cable ties serve many different uses ranging from automobile construction through bundling wires, to almost anything else which might require a strap tied around it. The wide spread use of cable ties attests to their reliability, convenience, and overall utility. Nevertheless, problems persist. For example, in some hostile environments the strap may break, especially at the point where the pawl locks into it. These hostile environments may include a combination of many factors, the most common of which involves very low humidity, or low humidity combined with low temperature or high temperature.

Another and related problem concerns the insertion force required to insert the strap through the hole in the head. This insertion force might increase substantially if an effort is made to solve the strap breakage problem merely by increasing the thickness of the strap. Increasing the strap thickness increases the bending characteristics (more rigid) when wrapping a cable tie around a circular bundle.

Therefore, an objective in solving the strap breakage problem is to provide a greater than average amount of plastic at a point where a strap may break while avoiding a substantial increase in the insertion or bending forces that normally result from merely adding a greater amount of material in the strap and the pawl. This object is accomplished by providing two locking pawls, both of which must break before the strap is released. Two examples of dual locking devices, which are not provided on cable ties, are found in U.S. Pat. Nos. 4,128,919 and 3,155,987. Since these two patents are not directed to cable ties, they do not face the problems outlined above such as increased insertion force and change in effective cable tie thickness which increase the stiffness of the strap and makes it more rigid and resistant to bending.

Accordingly, an object of this invention is to provide new and improved cable ties, especially for use in hostile environments. Here, an object is to provide cable ties for use in environments having an extremely low humidity and/or low or high temperature. Another object of the invention is to increase the effective thickness of a cable tie strap without substantially increasing the amount of material in said cable ties. Here, an object is to provide a cable tie strap having a substantially greater average thickness without simultaneously increasing the insertion forces required to install the cable tie. In this connection, an object is to reduce the notch effect caused by the transverse teeth extending across substantially the entire width of the strap.

Yet another object of the invention is to provide pawls having a reduced insertion force without simultaneously reducing the thickness of the pawl hinge.

In keeping with an aspect of the invention, these and other objects are accomplished by providing a median strip down the middle of a rack of teeth and extending longitudinally along the length of the cable tie strap. The median strip leaves two racks of strap teeth, each rack having a width approximately equal to half of the width of the previously used rack of teeth. In one embodiment, the teeth on one side of the median strip are offset a half step as compared to the teeth on the opposite side of the median strip so that the root of a strap tooth notch on one side of the median does not coincide with the root of the opposing tooth on the opposite side of the median. In another embodiment, the teeth are aligned, but extra plastic is placed in the median strip. The pawl is bifurcated to straddle the median strip, with each pawl engaging an individually associated one of the two racks of teeth. In the first embodiment, the pawl on one side of the cable tie has teeth which are a half a tooth higher than the teeth on the opposite pawl so that both pawls engage a locking tooth at the same time.

A preferred embodiment of the invention is shown in the attached wherein.

Figures 1, 2, 3, 4, 5, 6, 7, 8, 9, 10:
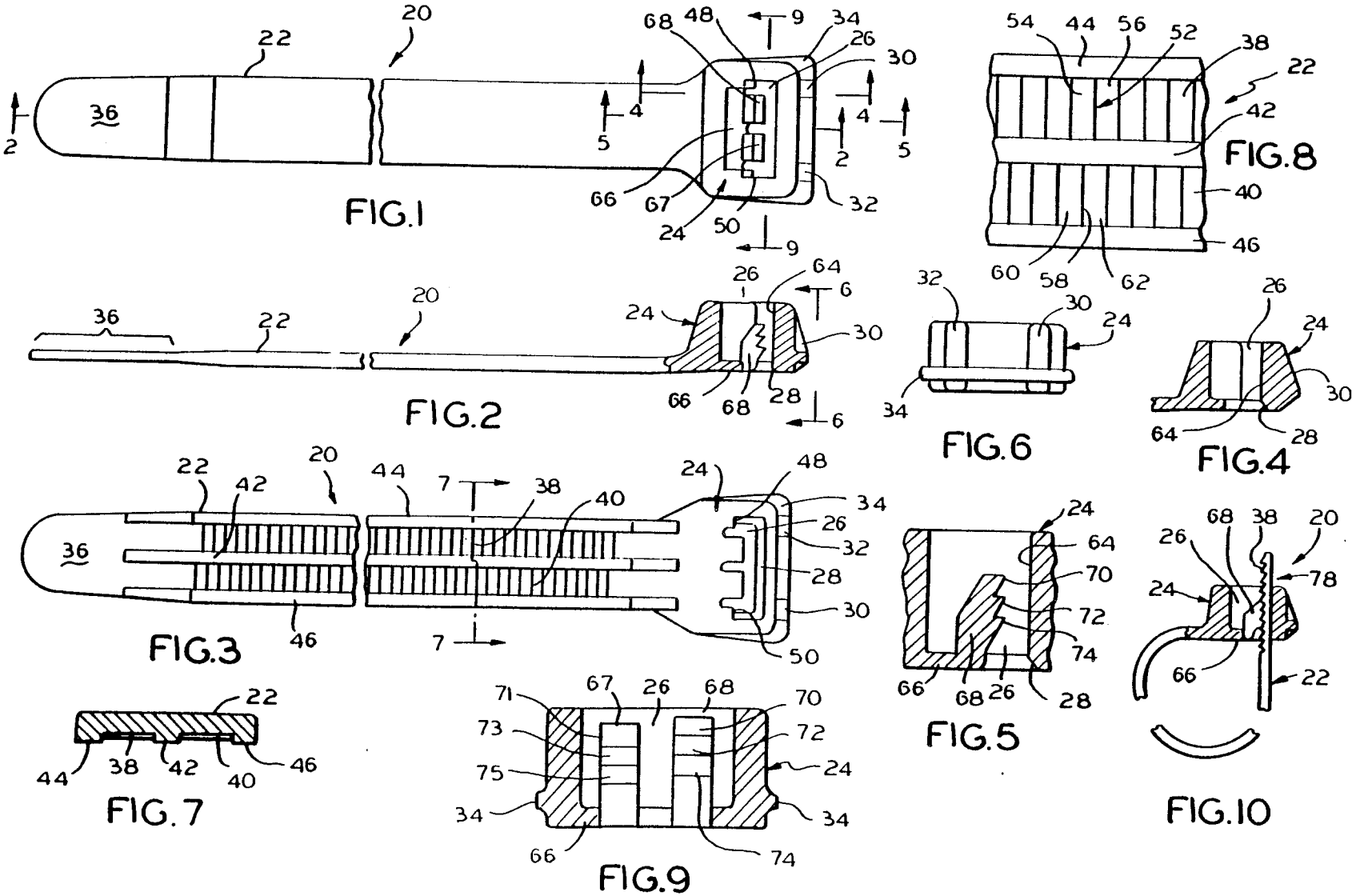
FIG. 1 is a plan view of a first embodiment showing the top of the inventive cable tie.
FIG. 2 is a side elevation of the cable tie shown in FIG. 1, with the shown in cross-section to reveal the pawl.
FIG. 3 is a plan view showing the bottom of the cable tie and revealing median strip with two racks of teeth.
FIG. 4 is a cross-section of the head of the cable tie, taken along line 4—4 of FIG. 1.
FIG. 5 is a cross-section of the head taken along line 5—5 of FIG. 1.
FIG. 6 is an end view of the cable tie, taken along line 6—6 of FIG. 2.
FIG. 7 is a cross-section of the strap taken along line 7—7 of FIG. 3.
FIG. 8 is a fragmentary plan view showing the first embodiment of the strap with teeth on one side of the median strip which are offset relative to the teeth on the other side of the strip.
FIG. 9 is a cross-section of the head taken along line 9—9 of FIG. 1 and showing how the pawl teeth are offset to match the position of teeth in the embodiment of FIG. 8.
FIG. 10 shows a cable tie which has been locked with the strap extending through the head and being held by the pawl.
Figure 11:
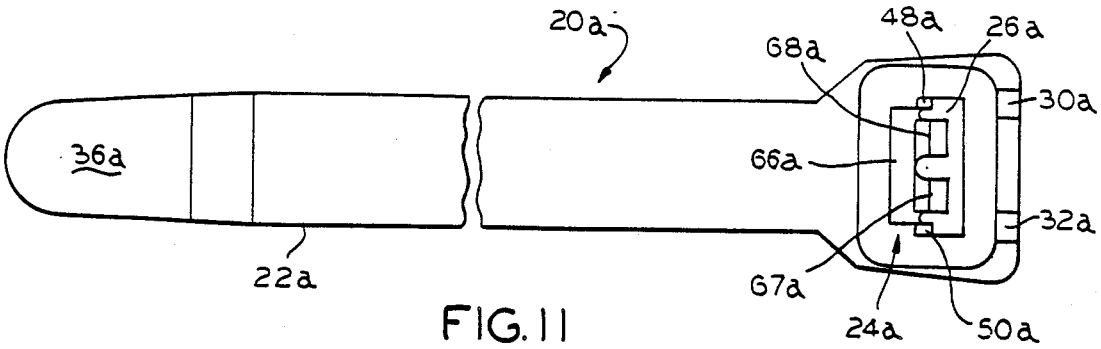
FIG. 11 is a top plan view of a second embodiment of the invention.
Figure 12:
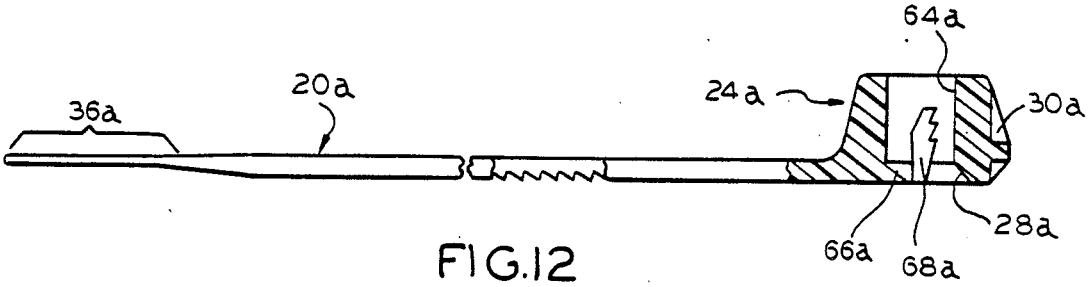
FIG. 12 is a side elevation taken along line 12—12 of FIG. 13 with a partially, broken cross section of the second embodiment of the cable tie, as well as a pawl for securing the teeth of the strap.

As best seen in FIGS. 1-3, the cable tie 20 has an integral strap 22 and head 24. The head 24 has an opening 26 through which the strap may be inserted. The bottom of opening 26 is chamfered at 28 to assist strap insertion. Reinforcing ribs 30, 32, 34 reinforce the head walls to provide a greater strength and rigidity.

The opposite and outer end 36 of the strap is rounded and thinner to facilitate an insertion of the strap end into the head opening. Also the thinness of section 36 makes it easier to thread the strap through a narrow place of installation and to cause it to begin to curl back upon itself so that the end may be grasped and pulled into a threading position. For example, if the cable tie strap has to be threaded through a bundle of wires resting against a wall, the thinness of end 36 makes it easier for the tip end to engage the wall and to be deflected back upon itself.

Extending along the length of the strap 22 are two racks 38, 40 of teeth, separated by a raised, reinforcing median strip 42. The outside side walls 44, 46 provide smooth side rails for sliding against shoulders 48, 50 in the head opening 26.

As best seen in FIG. 8, a preferred embodiment has teeth in the rack 38 on one side of median strip 42 offset from the teeth in the rack 40 on the opposite side of the median strip. For example, the line 52 represents both the crest of tooth 54 and the root of tooth 56. The line 58, which is the crest of tooth 60 and the root of tooth 62, is offset from the root 52 of tooth 56. Since the root of a tooth is the thinnest part of the strap, that thinness does not extend more than halfway (excluding median strip 42, and side walls 44, 46) across the inventive strap. Thus the average total strap thickness at 52 includes the full height of walls 44, 46, median strip 42, the root thickness at 52 and half of the average thickness of tooth 62.

In the prior art, the median strip 42 was not present and the root line of each tooth extended in a straight line from side rail 44 to side rail 46. Therefore, the thinnest part of the strap extended not only across the entire width of the strap, but also was repeated at the root of every tooth. This gives a repetition of the weakest possible strap thicknesses. With the invention, the strap at the tooth root 52 has half of its maximum thickness at the transversely opposite position where the strap at the tooth 62 has its minimum thickness. This means that the strap 22 never has a minimum thickness comparable to the minimum thickness of the conventional cable tie strap. To this inventive increase in minimum strap thickness is added the thickness of the median strip 42 (FIG. 7).

The details of head 24 of the first embodiment of the cable tie 20 are shown in FIGS. 4, 5, 6, and 9. The outside wall of the head is reinforced by an equatorial girdle 34 extending horizontally around the abutment wall 64 against which the pawls bear. Vertically, a pair of upstanding pillars 30, 32 also reinforce the abutment wall.

Inside the opening, a hinge area 66 extends over approximately the half of opening 26 which is closest to the strap. Upstanding on this hinge area 66 is a pair of pawls 67, 68. Each pawl has a plurality of teeth with contours which are complementary to the contours of the rack teeth. As best seen in FIG. 9, the teeth 70, 72, 74 on pawl 68 are displaced from corresponding teeth 71, 73, 75 of pawl 67, to correspond to the displacement (FIG. 8) of the teeth in rack 38, with respect to the position of the teeth in rack 40. The median strip guides and directs the pawls as they ratchet and come to rest in a locking position so that they are always centered over and aligned with their associated teeth. Thus, each tooth in each of the pawls simultaneously abuts against a corresponding tooth in the strap to provide a simultaneous lock upon the strap.

FIG. 10 shows the use of the cable tie 20, wherein the end of the strap 22 has passed through the opening 26 in the head 24. The racks of teeth have passed the pawls, which have ratcheted over them in order to enable the strap to tighten. As shown in FIG. 10, the teeth on rack 40 have meshed into the teeth on pawl 68 which is propped in a locking position against the engaged strap teeth. Responsive to the memory of the plastic, the pawl is pressed against the strap with a force which is sufficient to prevent it from being withdrawn from the head. In a similar manner, the pawl 67 (FIG. 9) is locked into teeth of the rack 38. Usually the strap is pulled to a predetermined tension and then cutoff at the point 78 (FIG. 10) where it emerges from head 24.

Since the total tooth width of pawls 67, 68 is less than the corresponding width of a pawl extending across the entire cable tie strap, a reduced insertion force is required to thread the strap end through the opening 26.

Despite this reduced insertion force, the hinge area 66 retains all of the thickness which is required when the strap tooth extends across the entire width of the strap. Therefore, the hinge is not weakened. Moreover, in the first embodiment, the offset tooth position illustrated in FIG. 8 maintains a greater average strap thickness and avoids the notch effect weakness at the root of the tooth. Further, as shown in FIG. 7, the added thickness of center median 42 plus the offset teeth gives the strap approximately 25% more strap material in the thickness direction, as compared to the thickness of the prior art strap which had only the side rails 44, 46. Finally, the addition of a second independent pawl inherently tends to increase reliability over a single pawl since two simultaneous failures are much less likely to occur than a single failure.

A second embodiment of the invention is shown in FIGS. 11–14 which use the same reference numerals, with the suffix "a" added to identify parts with the same reference numerals in FIGS 1–13.

The cable tie **20*a* has an integrated strap 22*a* that bears a pair of racks 38*a* and 40*a* of teeth that extend longitudinally along the length of the strap. The two racks are separated by a raised, reinforcing median strip 42*a*. The outside walls 44*a*, 46*a* of the strap provide smooth side rails for sliding against shoulders 48*a*, 50*a* in the head opening 26*a***.

Figure 13:
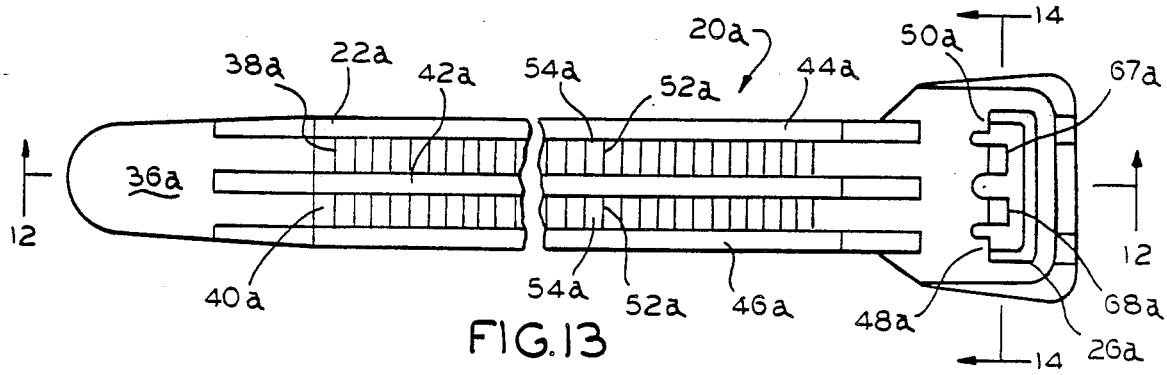
FIG. 13 is a bottom plan view of the second embodiment of the cable tie of FIG. 12 showing aligned teeth provided along the length of the strap.

As can be seen in FIG. 13, in the second embodiment of the invention, teeth in the rack **38*a* on one side of the median strip 42*a* are in contiguous alignment with teeth in the rack 40*a* on the opposite side of the median strip. Therefore, lines 52*a*, 52*b* represent the aligned crests of teeth 54*a*, 54*b* in racks 38*a* and 40*a*, respectively (or the aligned roots of the next successive teeth). Thus, the amount of plastic in the median strip 42*a*** may be increased so that the root portions of the teeth of the racks may be in alignment without weakening the structure.

Figure 14:
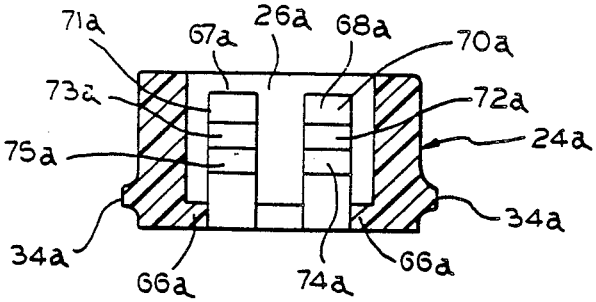
FIG. 14 is a cross-section of the head taken along the line 14—14 of FIG. 13.

The details of the head **24*a* of the cable tie 20*a* are shown in FIG. 14. A hinge area 66*a* extends over approximately the half of opening 26*a* (FIG. 12) which is closest to the strap. Upstanding on the hinge area 66*a* is a pair of pawls 67*a*, 68*a* (FIG. 14). Each pawl has a plurality of teeth with contours which are complimentary to the contours of the rack teeth. As such, the teeth 70*a*–74 a on pawl 68*a* are aligned with corresponding teeth 71*a*–75*a* on the rack 40*a***. Therefore, each tooth on both of the pawls simultaneously abuts against a corresponding tooth in the strap to provide a simultaneous lock by propping itself against the strap.

The choice between the first and second embodiments depends upon the needs and acceptable costs of the inventive cable tie. The first embodiment of FIGS. 1–10 should provide the least insertion force-to-holding ratio, for the amount of plastic that is used. The second embodiment is easier to manufacture at a slightly lower cost. The dimensions of the median strip and side rails of the second embodiment may be increased to provide approximately the same amount of plastic that is provided in the first embodiment. Each of the embodiments provide the reliability of twin pawls whereby, if one pawl should break, the other pawl remains to hold the lock. Also, each of the embodiments have a median strip to hold the respective pawls in central alignment with its respective rock of teeth, during both ratcheting and locking.

Those who are skilled in the art will readily perceive how to modify the invention. Therefore, the appended claims are to be construed to cover all equivalent structures which fall within the true scope and spirit of the invention.

What is claimed is:

1. A cable tie comprising a unitary strap and head, said strap having a spaced parallel pair of racks of teeth extending along the length thereof, each of said teeth having a root and a crest with the crest of one tooth integrally joining the root of the next tooth with no break between them, said teeth in one of said racks being juxtaposed in an aligned relationship with the teeth in the other of said racks whereby crests of said teeth in each of said racks are in contiguous alignment, a pair of cantilevered positioned side-by-side with in said head to confront, to pivot, and to prop at a free end against individually associated ones of said racks of teeth, said racks being separated by a medium strip having a substantially full strap thickness which at least equals the thickness of the strap at the crests of the teeth for adding plastic to said strap in the area where said free end of said cantilevered pawls prop against said teeth in said strap, said pawls being separated from each other by a distance approximately equal to the width of said median strip so that each pawl is guided and directed by said median strap as it ratchets over its individually associated one of said rack of teeth to come to rest in a propping position against confronting teeth on said strap.

2. The cable tie of claim 1 wherein each of said teeth has a predetermined contour, and each of said pawls has a plurality of teeth with contours which are complementary to the contours of said teeth in said rack.

3. The cable tie of claim 2 wherein the teeth on one of said pawls is juxtaposed in parallel relationship with the teeth on the other of said pawls whereby the crests of the teeth of said pawls are in side-by-side alignment.

4. An integral, plastic fastener comprising a continuous and unbroken strap having a securing means at one end, the opposite end of said strap being free, said strap having two spaced parallel rows of teeth extending along the length of said strap, each of said teeth in said rows rising from a root of a discrete strap thickness to a crest of greater strap thickness, said teeth in one of said rows being juxtaposed in an aligned relationship with the teeth in the other of said rows whereby the crests of said teeth in each of said racks are in contiguous alignment, said two rows of teeth being separated by a median strip having a thickness that is substantially as great as at least the thickness of said strap at a crest of said teeth, and a cantilevered hinged pawl associated with each of said rows of teeth, each pawl having teeth which are complementary to and which ratchet over and latch by propping against said teeth in the row associated therewith, said pawls being guided and directed by said median strip as they ratchet over said teeth and come to rest in a locking position.

5. The fastener of claim 4 wherein each pawl has a plurality of teeth, the teeth on one of said pawls being juxtaposed in an aligned relationship with the teeth on the other of said pawls whereby the crests of the teeth of each of said pawls are in contiguous alignment, the teeth of each of said pawls simultaneously propping themselves against the teeth in each of said two rows of said teeth.

6. An integral, elongated plastic device having a continuous and unbroken strap on one end and a fastener on the other end, a plurality of rows of spaced parallel teeth extending along the length of the strap, each of said teeth rising from a root to a crest with at least a minimum amount of plastic strap thickness at said rotor and a maximum amount of plastic strap thickness at said crest, the average strap thickness at any transverse location along the length of said strap being greater than said minimum amount, said teeth in each of said rows being juxtaposed in an aligned relationship whereby the crests of said teeth in each of said rows are in substantially contiguous alignment, two side walls extending along opposite edges of said strap, a median strip extending along the length of said strap between adjacent rows of said teeth, said side walls and said median strip having a plastic strap thickness at least as great as said maximum amount of plastic strap thickness, a hinged pawl securing means on said fastener and individually associated with each of said rows for ratcheting over said teeth in said rows, said hinged pawl securing means propping against and locking into at least one of said teeth to preclude a loosening of said strap.

7. The device of claim 6 wherein said hinged pawl securing means props itself against teeth in said rows of spaced parallel teeth to prevent a reverse movement of said strap.

8. The device of claim 6 wherein the teeth against which said securing means is propped are transversely distributed across the width of said strap.

* * * * *